United States Patent [19]

Blair

[11] Patent Number: 5,007,384

[45] Date of Patent: Apr. 16, 1991

[54] L-HEAD TWO STROKE ENGINES

[75] Inventor: Gordon P. Blair, Newtownabbey, Northern Ireland

[73] Assignee: The Queen's University of Belfast, Belfast, Northern Ireland

[21] Appl. No.: 484,072

[22] Filed: Feb. 22, 1990

[30] Foreign Application Priority Data

Feb. 22, 1989 [GB] United Kingdom ..... 8904043

[51] Int. Cl.[5] ..... F02B 75/04

[52] U.S. Cl. ..... 123/48 A; 123/52 A; 123/70 R; 123/658

[58] Field of Search ..... 123/52 A, 51 BA, 51 B, 123/658, 48 A, 48 AA, 78 A, 78 AA, 70 R, 70 V, 65 BA, 257, 265

[56] References Cited

U.S. PATENT DOCUMENTS

| | | | |
|---|---|---|---|
| 2,442,082 | 5/1948 | French | 123/51 B |
| 3,675,630 | 7/1972 | Stratton | 123/70 R |
| 3,923,019 | 12/1975 | Yamada | 123/257 |
| 3,934,562 | 1/1976 | Isaka | 123/257 |
| 3,970,057 | 7/1976 | Schauer | 123/51 BA |
| 4,033,304 | 7/1977 | Luria | 123/48 A |
| 4,352,343 | 10/1982 | Batoni | 123/51 BA |

*Primary Examiner*—David A. Okonsky

*Attorney, Agent, or Firm*—Skjerven, Morrill, MacPherson, Franklin & Friel

[57] ABSTRACT

An L-head two stroke engine comprises two pistons mounted for reciprocable movement in first and second cylinders respectively. The cranks of the two pistons are drivably connected such that the pistons are in phase. A fuel/air supply is provided for one cylinder where it is compressed and ignited causing both pistons to return to their respective bottom dead center position. The compression ratio in the one cylinder is less than in the other cylinder so as to aid retention of the air fuel mixture in the one cylinder prior to ignition.

7 Claims, 3 Drawing Sheets

L-HEAD TWO STROKE ENGINES

This invention relates to L-head two stroke engines.

L-head two crank engines are known in the art. These L-head engines comprise two cylinders in perpendicular relation. One cylinder delivers a stratified fuel charge by swirling flow of the fuel to the other cylinder where the fuel charge is compressed and ignited causing the pistons in the cylinders to return to their respective bottom dead central positions.

These prior art engines have not proven particularly efficient.

The present invention seeks to provide a two stroke L-head engine with improved efficiency.

According to the present invention there is provided an L-head two stroke engine comprising first and second pistons mounted for reciprocable movement in first and second cylinders respectively and drivably connected to first and second cranks respectively, drive means drivably connecting first and second cranks, means for supplying fuel to one of the cylinders, ignition means for igniting the fuel in that cylinder, means providing a communication between the two cylinders whereby in operation the compression ratio in the said one cylinder is less than that in the other cylinder. This arrangement aids retention of swirling air fuel mixture within the said one cylinder prior to ignition of the air fuel mixture.

In a preferred embodiment, the means providing a communication comprise an orifice. The compression ratio in the other cylinder adjacent the orifice is in the order of 10 to 25 times larger than, for example fifteen times larger than that in the said one cylinder adjacent the orifice. In another example, the compression ratio in the other cylinder adjacent the orifice may be approximately 12 times larger than the compression ratio in the said one cylinder adjacent the orifice.

The apparatus of the invention enhances the swirling mixing process of the air fuel mixture in the said one cylinder by the compression process in the other cylinder.

Either cylinder may have a variable compression ratio to enhance the thermodynamic efficiency of a certain load. The variable compression ratio may be achieved by way of a variable compression ratio actuator movably provided within the cylinder.

The two-stroke engine has improved cyclic firing at idle and light load conditions by direct delivery of air and fuel to the combustion chamber.

The invention also provides a self-starting turbocharged two-stroke cycle engine.

In order that the invention may be more readily understood, a specific embodiment thereof will now be described with reference to the accompanying drawings, in which.

Similar reference numerals are used to represent like parts.

Figure 1:
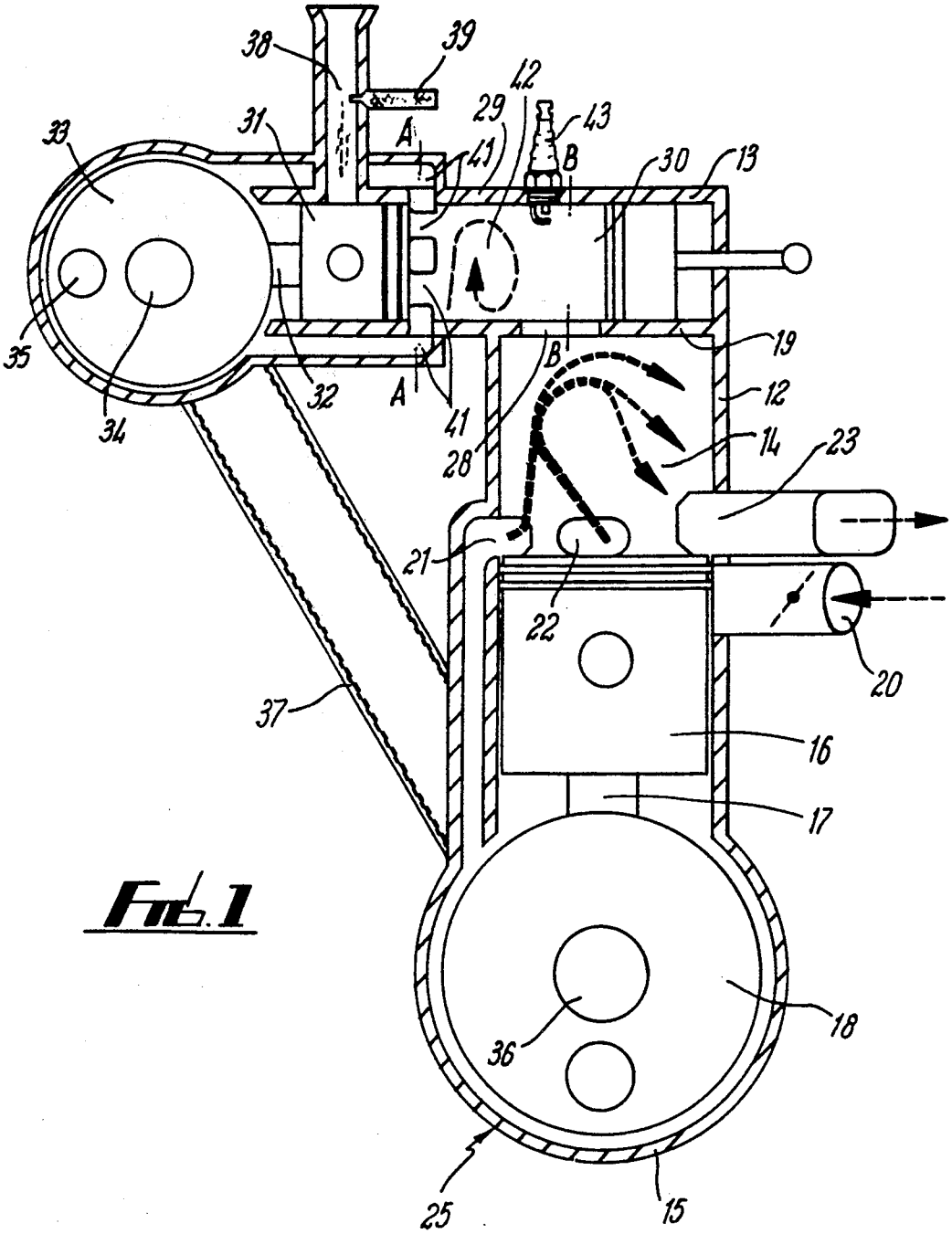
FIG. 1 is an illustrative diagram of one embodiment of the invention.

Referring to the drawings, an L-head two stroke engine 10 comprises two arms 12, 13. The first arm 12 defines a cylinder 14 of substantially uniform diameter which passes into the area defined by the crankcase 15, the crankcase 15 being represented as substantially circular in end elevation. A piston 16 is provided in the cylinder 14. The piston 16 is connected via a piston rod 17 to the crank 18. The piston 16 is movable under the action of the rotating crank 18 from a first position as shown in FIG. 1 in which the piston is at its lowermost position or bottom dead centre to a second position in which the top of the piston is substantially adjacent the top 19 of the first arm 12.

An air inlet 20 allows air to pass into the cylinder 14 via air ports 21,22. Exhaust gasses may escape via exhaust port 23.

The top 19 of the first arm 12 also forms part of the cylinder wall 29 of the second arm 13. An orifice 28 passes through the top 19 of the first arm, thus connecting the first cylinder 14 with the second cylinder 30 which is provided in the second arm 13. The orifice 28 is offset towards one side of the top 19 as is clearly seen in FIG. 3.

A second piston 31 is provided in the second cylinder 30. The second piston 31 is connected to a rotatable crank 33 via piston rod 32 and connection 35, the connection 35 being offset from the centre of the crank 33. The crank 18 in the first arm 12 drives the crank 33 thus causing reciprocable movement of the piston 31. This is achieved by coupling the shafts 36,34 of the cranks 18,33 in the first and second arms 12, 13 by a drive mechanism such as a toothed belt 37.

Figure 2:
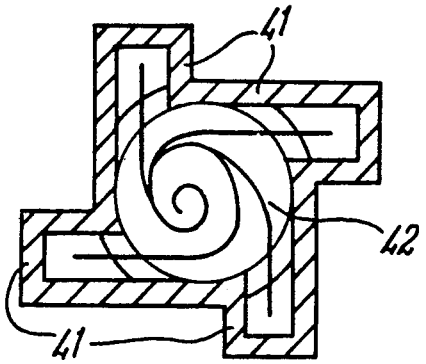
FIG. 2 is a cross-section along the line A—A of FIG. 1.

An air intake 38 is provided to supply air into the cylinder 30. Fuel is also supplied into this air intake via a carburetter or fuel injection system 39. The air fuel mixture passes through the air intake 38 into the cylinder 30 via transfer ports 41. The arrangement of transfer ports 41 is more clearly shown in FIG. 2.

The compression ratio of the cylinder 30 may be varied by slidably moving the variable compression ratio actuator 45 so as to alter the length of the cylinder 30.

Ignition means such as a spark plug is provided in the cylinder 30. The spark plug is located in the wall 29 of the cylinder 30 substantially opposite the orifice 28. That is more clearly shown in FIG. 3.

In this embodiment the capacity of the first cylinder 14 is substantially 400 cc and the capacity of the second cylinder 30 is substantially 50 cc. It will be appreciated that the capacities of the two cylinders may be varied as required.

In use the cranks are preferably coupled such that the pistons are in phase. When the pistons 14,30 are in their respective bottom dead central positions as shown in FIG. 1, the air fuel mixture 42 from air intake 38 enters the second cylinder 30 with a swirling motion via ports 41. This is more clearly illustrated in FIG. 2. Simultaneously, exhaust gases pass out through exhaust port 23 of the first cylinder 14.

The swirling motion of the air fuel mixture 42 prevents rapid movement of the air fuel mixture towards the orifice 28. Also, when the first piston is at the bottom dead centre, the differential compression prevents the exit of the air fuel mixture from the second cylinder 30. Typically, the compression ratio in the second cylinder 30 before the orifice 28 is approximately twelve times larger than the compression ratio in the first cylinder 14 before the orifice, the overall compression ratio in this example being about ten (geometric) or 7.5 trapped when running on gasoline fuel. The overall value of compression ratio depends on the type and quality of fuel which is being combusted. Thus the pressure rise in the cycle after the piston 16 rises from bottom dead centre, as shown in FIG. 1, is always greater in the first cylinder 14 than the second cylinder 30. As a result of this, substantially no further movement of fresh fuel air mixture through the orifice 28 into the first cylinder 14 is allowed. Almost perfect trapping of the fuel air mixture in the second cylinder 30 is thereby provided. As the cranks 17, 32 rotate, the pistons 16, 31 rise towards the tops of their respective cylinders.

Figure 3:
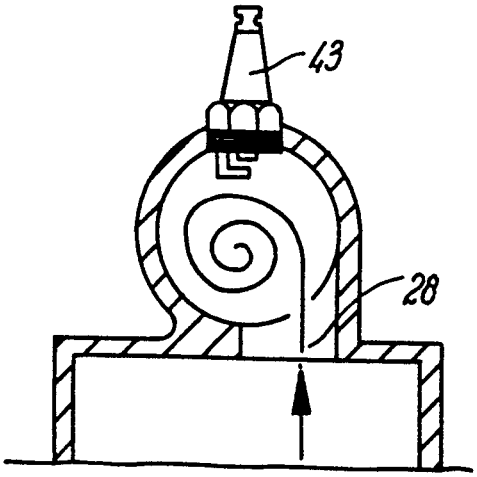
FIG. 3 is a cross-section along the line B—B of FIG. 1.

As the orifice 28 is offset, the swirling motion of the air fuel mixture emanating from the transfer ports 41 is enhanced by the compressing action of the piston 16 as it rises towards the top 19 of the first cylinder 14. This compressing action provides the fuel air mixture with a tumbling motion as it approaches the spark plug 43 which is illustrated in FIG. 3.

The swirling motion of the fuel charge continuing from the initial supply of fuel charge into the second cylinder through to the onset of combustion is necessary to provide thorough vapourisation of a liquid fuel such as gasoline.

When the two pistons are at the top dead centre of their respective cylinders, the spark plug ignites the air fuel mixture causing the pistons to return to their original positions. The cyclic process then continues until the engine is switched off.

The compression ratio may be varied so as to extract the highest thermodynamic efficiency at a given load point. By doing this, the engine's potential to operate efficiently as a multi-fuel power unit would be increased as would the efficiency of operation at altitude if the engine were used in an aircraft.

Figure 4:
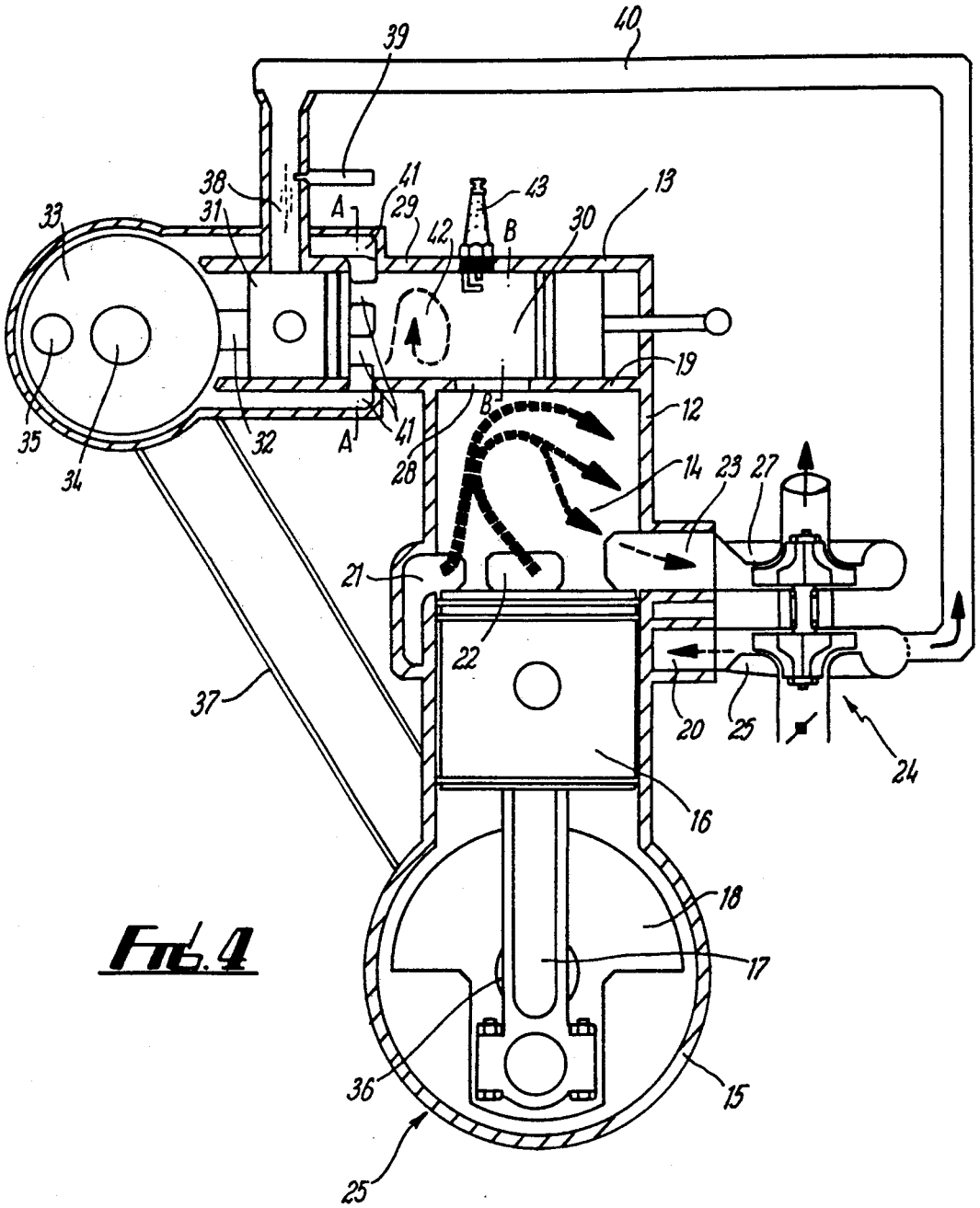
FIG. 4 is an illustrative diagram of a second embodiment of the invention.

Referring now to FIG. 4 there is shown a second embodiment of the invention. The embodiment of FIG. 4 is similar to that illustrated in FIG. 1 except that a turbocharger 24 is provided adjacent the air inlet 20 and exhaust port 23.

The air intake 25 of the turbocharger 24 is connected to the air inlet 20. The air intake 25 of the turbocharger is also connected to the air inlet 38 of the second cylinder 30. The exhaust port 23 of the first cylinder 14 is connected to the turbocharger exhaust 27.

The air intake 38 as shown receives air from the turbocharger air intake 25 via connection means 40.

The engine hereinbefore described may be able to operate with a single throttle, for example at the air intake 38 of the second cylinder 30 in conjunction with a supercharger or with a turbocharger as illustrated in the embodiment of FIG. 4. This would leave the engine idling at wide open throttle with the fresh fuel air charge being delivered directly into the second cylinder 30 for combustion and little or no air entering the first cylinder 14 at the idle throttle setting. This provides improved light load running of the engine as the correct means of air at the correct fuel air ratio is delivered directly to the combustion chamber.

Also, as the first cylinder 14 still retains the air pumping capability and the second cylinder 30 does not, the engine is self starting by rotating the crankshaft 34 at the first cylinder 14 in the normal manner.

The engine of the present invention, when connected to a turbocharger should provide an engine with improved fuel efficiency, reduced engine bulk and less blower noise when compared to the prior art engines of this kind which tend to use a supercharger for starting reasons.

It will be appreciated that the above described embodiments have been described by way of example only and that many variations are possible without departing from the scope of the invention.

For example, the variable compression ratio actuator described in the specific embodiments of the invention is an optional feature and therefore need not be present.

I claim:

1. An L-head two stroke engine comprising a first cylinder and a second cylinder, the two cylinders being connected to one another in perpendicular relation, a first piston mounted for reciprocable movement in the first cylinder and a second piston mounted for reciprocable movement in the second cylinder, a first crank and a second crank, a drive means drivably connecting the first and second cranks, means for supplying fuel to one of the cylinders, ignition means for igniting fuel in said one cylinder and means providing a communication between the two cylinders whereby in operation the compression ratio in said one cylinder is less than that in the other cylinder.

2. An L-head two stroke engine as claimed in claim 1, wherein said means for providing communication between the two cylinders comprises an orifice.

3. An L-head two stroke engine as claimed in claim 2, wherein the compression ratio in said other cylinder adjacent the orifice is in the range from 10 to 25 times larger than that in the said one cylinder.

4. An L-head two stroke engine as claimed in claim 3, wherein the compression ratio in said other cylinder adjacent the orifice is substantially fifteen times larger than in the said one cylinder.

5. An L-head two stroke engine as claimed in claim 1, wherein at least one of the cylinders has a variable compression ratio.

6. An L-head two stroke engine as claimed in claim 5, wherein the variable compression ratio is achieved by way of a variable compression ratio actuator provided within said at least one cylinder.

7. An L-head two stroke engine as claimed in claim 1, wherein the exhaust gases from the engine drives a turbo charger.

* * * * *